United States Patent [19]

Seals

[11] 4,022,472

[45] May 10, 1977

[54] TARGET GAME

[76] Inventor: Calvin L. Seals, P.O. Box 424, Daphne, Ala. 36526

[22] Filed: Nov. 24, 1975

[21] Appl. No.: 634,745

[52] U.S. Cl. ..... 273/105 R

[51] Int. Cl.[2] ..... A63B 63/00

[58] Field of Search ..... 273/95 R, 95 A, 101, 273/102 R, 102 S, 103, 105 R, 105 A, 102.4, 88, 26 A, 181 R, 181 A

[56] References Cited

UNITED STATES PATENTS

| | | | |
|---|---|---|---|
| 713,275 | 11/1902 | Atkins | 273/105 R |
| 834,581 | 10/1906 | Lambert | 273/105 R |
| 999,940 | 8/1911 | Wood | 273/95 R |
| 1,785,150 | 12/1930 | Soubier | 273/105 R |
| 1,996,986 | 4/1935 | Weinberg | 273/105 R |
| 2,224,962 | 12/1940 | Hines | 273/105 R |
| 2,397,921 | 4/1946 | Cole | 273/102.4 |
| 2,455,185 | 11/1948 | May | 273/105 R |
| 2,827,297 | 3/1958 | Foster | 273/102.4 |
| 2,988,360 | 6/1961 | Lambiotte | 273/105 R |
| 3,035,838 | 5/1962 | Johnston | 273/105 R |
| 3,111,318 | 11/1963 | Northrup | 273/88 |
| 3,202,429 | 8/1965 | Richman | 273/182 |
| 3,594,006 | 7/1971 | Glatt | 273/176 |
| 3,656,750 | 4/1972 | Meunier | 273/105 P |
| 3,802,703 | 4/1974 | Tassel | 273/95 R |
| 3,817,528 | 6/1974 | Stuhler | 273/102.4 |
| 3,822,883 | 7/1974 | DeVos | 273/95 H |

*Primary Examiner*—Richard C. Pinkham
*Assistant Examiner*—Arthur S. Rose
*Attorney, Agent, or Firm*—Cushman, Darby & Cushman

[57] ABSTRACT

A target game including a target and one or more balls, which may be utilized to play a wide variety of different games, and the target of which is readily foldable into an essentially two-dimensional structure. The target, when made of foldable sheet material, includes four cutouts including a top cutout, bottom cutout, divider cutout, and support cutout. When the cutouts are assembled to construct the target, the target has closed back, bottom, top, and side walls, an open front, upper and lower chambers with portions of the target adapted to retain a ball bounced into one of the chambers in that chamber, a pocket formed on the front of the support, and side flap members converging inwardly toward the open front of the target. The target may also be constructed of fabric covered frame members.

10 Claims, 7 Drawing Figures

Fig. 4
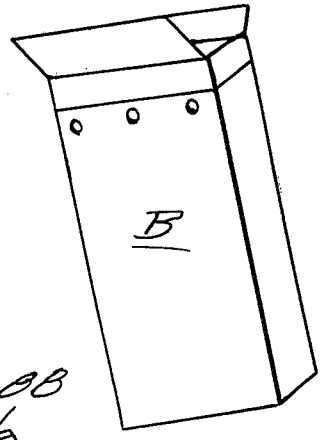
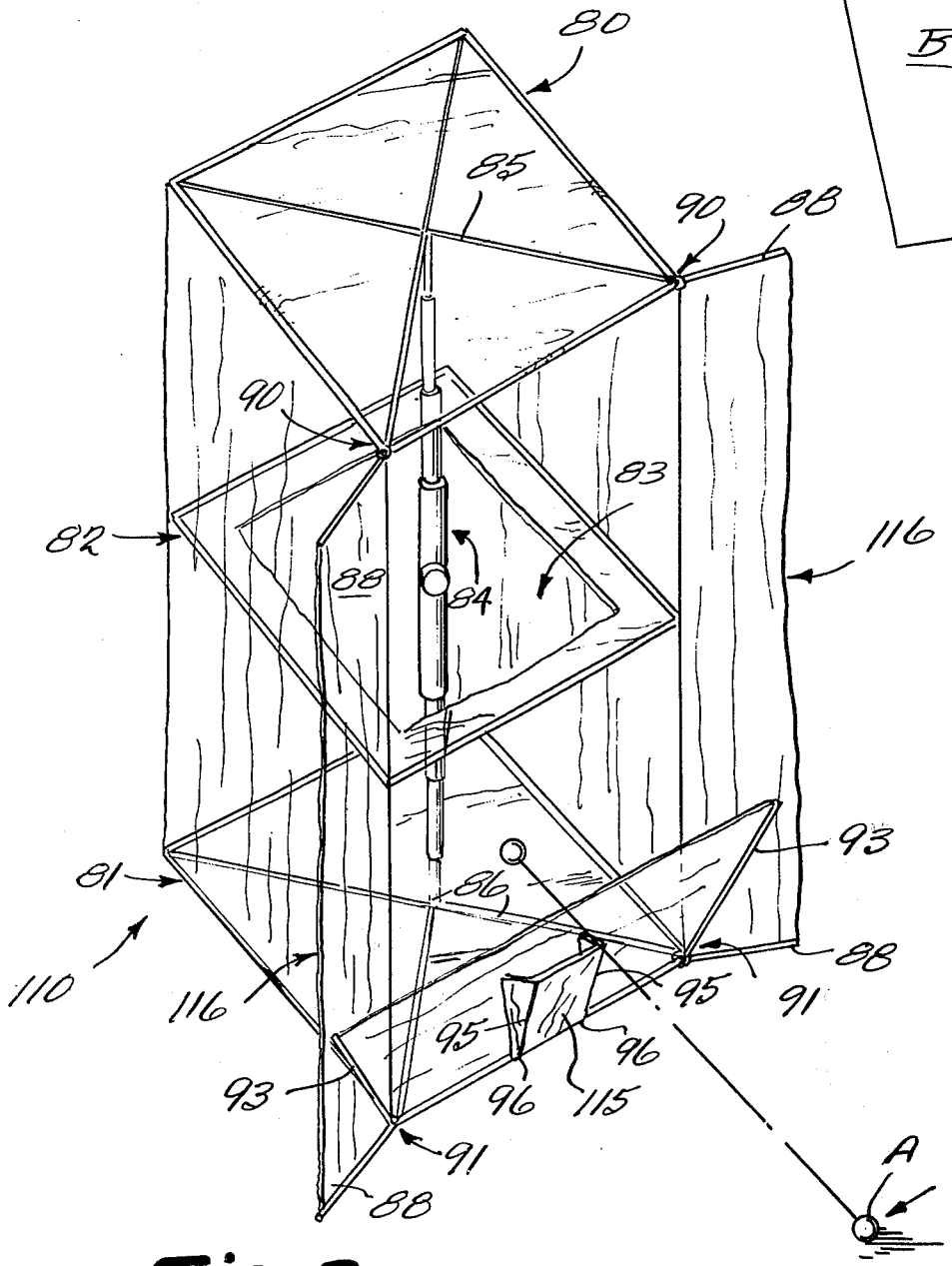
Fig. 3

TARGET GAME

BACKGROUND AND SUMMARY OF THE INVENTION

The invention relates to a target game and target thereof in general, and in particular to a target for a target game that has particularly formed chambers and pockets thereof and presents a relatively large target area but yet is readily foldable into a compact arrangement for transport or storage thereof, and for easy packaging thereof for marketing. The target game according to the present invention is also one that provides for a wide variety of games to be played therewith utilizing the same target and projectiles, to simulate baseball, golf, a tug of war, etc.

While numerous prior art devices are known that provide stationary targets having a number of pockets or chambers formed therein, such as shown in U.S. Pat. Nos. 3,111,318, 3,594,006 and 3,822,883, such targets when constructed of a size to be useful for their intended function are difficult to package and difficult to disassemble for easy transport or storing. Also, it is difficult to play a wide variety of games therewith using the same type of projectiles without modification of the particulars of the structures thereof.

According to the present invention, a target and a target game are provided wherein the target is readily foldable for packaging and storage, which target has a number of chambers and pockets formed therewith which lend themselves to use for a wide variety of games. The target comprises closed back, top, and bottom walls and a generally open front, a divider dividing it into top and bottom chambers, the divider having means associated therewith for receiving a ball therein which enters the target through the open front, and side flap members vertically extending along either side of the generally open target front, the plane of each flap member making an angle of greater than 90° with respect to the plane of the open front of the target. A flap portion also is provided which extends from the top of the target as generally the open front thereof into the interior of the target, making an angle of less than 90° with respect to the top of the target, so as to guide a ball into the top chamber of the target. A support member extends across the open front of the target at the bottom thereof, and the support member supports a pocket on the front thereof, the pocket being large enough to receive a ball therein. Thus a target according to the present invention includes three different and distinct areas for receipt of a ball therein, a top chamber, a bottom chamber, and a front pocket.

The target according to the present invention may be constructed in any number of ways so that it is foldable or disassembleable into an essentially two-dimensional structure for storage and/or transport. A preferred way is to construct the target out of cardboard or other foldable sheet material, and make the cardboard into interfitting top, bottom, divider, and support member cutouts, which cutouts are foldable along pre-scored lines thereof to interconnect to form the target, and Velcro strips, or other releasable attaching means, are provided for fastening portions thereof together. Another way is to form the target out of wire frame members, the top and bottom walls being connected by a telescoping connection or the like for allowing relative movement between the top and bottom walls to allow the target to be folded into a compact arrangement. The target may also be constructed of wood.

It is the primary object of the present invention to provide a new game with target therefor, which target is readily assembleable from a generally two-dimensional arrangement to a three-dimensional arrangement, and has a wide variety of games that may be played therewith. This and other objects of the invention will become clear from an inspection of the detailed description of the invention, and from the appended claims.

BRIEF DESCRIPTION OF THE DRAWINGS

FIG. 1 is a perspective view of an assembled exemplary target according to the present invention that is formed of stiff foldable sheet material, such as cardboard or the like;

FIG. 3 is a perspective view of another assembled target according to the present invention, that may be readily assembled and disassembled; and FIG. 4 is a perspective view of an exemplary packaging box in which the targets of FIGS. 1 and 3 may be placed when disassembled.

DETAILED DESCRIPTION OF THE INVENTION

Figure 1:
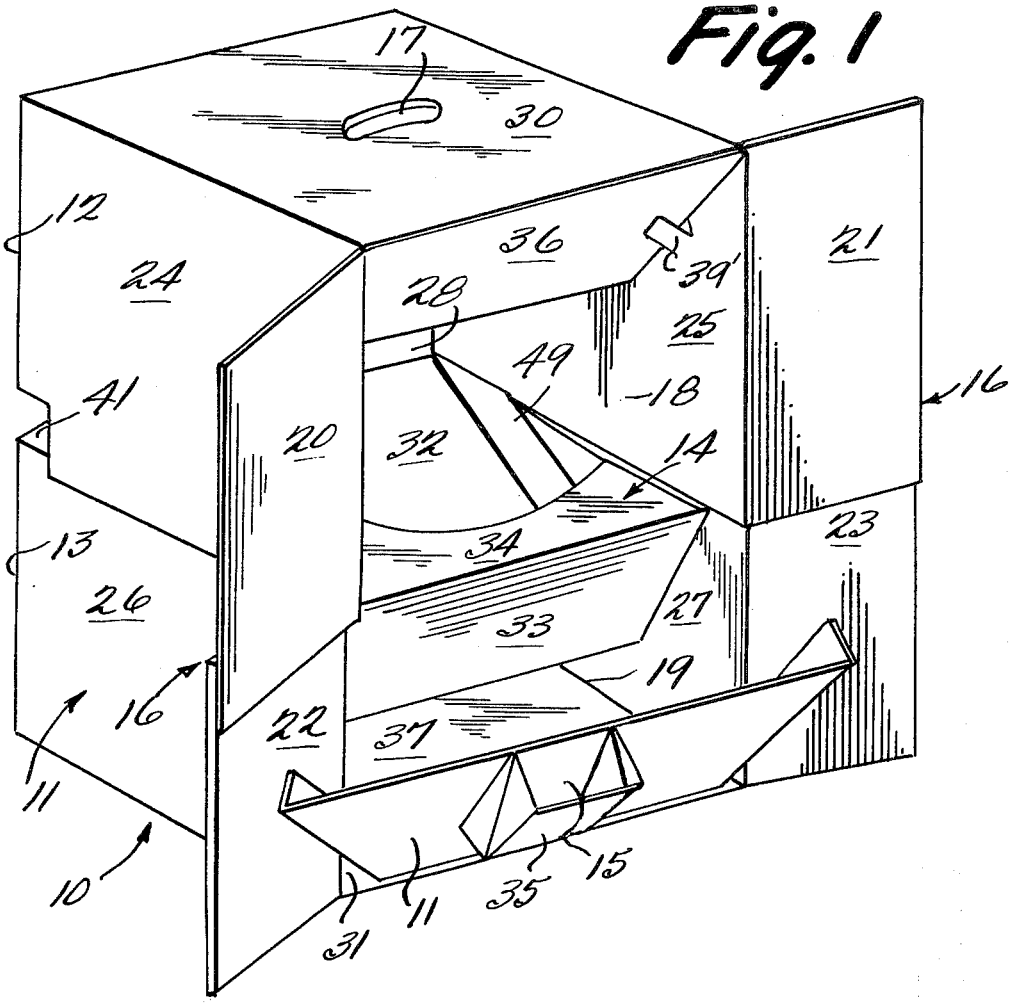

A target for a game according to the present invention is shown generally at 10 in FIG. 1. The target 10 generally comprises top and bottom portions 12 and 13, a divider 14 dividing the target into an upper chamber 18 and a lower chamber 19, a support member 11 for preventing a ball which enters lower chamber 19 from existing this chamber, the member 11 having a pocket 15 mounted on the front thereof, and a pair of side flap members 16 vertically extending along the height of the target 10 and slanting inwardly toward the interior of the target. A cutout 17 may be formed on the top of the target 10 for ease of carrying it around from place to place. The target is utilizable with one or more balls A (see FIG. 3) of resilient material which may be bounced into chambers 18 and 19 or pocket 15.

A wide variety of games may be played with the target and ball(s) according to the present invention. For instance, baseball may be played, with the pocket 15 being a home run. The bottom chamber 19 would be a single if a ball A was bounced therein on one bounce, a double if it entered after two bounces, a triple if it entered after three bounces, and a strickeout if it entered after four bounces. The top pocket would be an out (or sacrifice). Missing both the chambers and pocket would also be an out. Innings would be played just as in normal baseball.

The same target device 10 could then be used for playing golf. When playing golf, each "hole" being played would be assigned a par, either par 3 (usual), par 4, or par 5. When playing a par 3 hole, if the ball were bounced into pocket 15 it would be an eagle (hole-in-one), into chamber 19 it would be a birdie (2), and into chamber 18 a par (3). The above strokes (1, 2 or 3) would be added to any balls which missed the target during play of that hole, however; for instance, if a player on a par 3 hole missed the target with his first ball, and then bounced it into chamber 19 with his second, he would have $1 + 2 = 3$ strokes, or a par on that hole. For par 4 and 5 holes, 15 would again be an eagle, 19 a birdie, and 18 a par.

Tug-of-war could also be played with the target 10 of FIG. 1. Each player would try to be the first to reach a given number X, with one player's point total being subtracted from the other's. A ball on a single bounce in 15 would count four points, in 19, two points, and in 18, one point; for a double bounce, the point totals would be doubled. Three bounces would count as a miss (10), as would any miss of all the pockets and chambers. The first player to be X ahead of the other would win. Of course, all of these games could be played with more than two people, and a variety of other games also could be played.

Figure 2A:
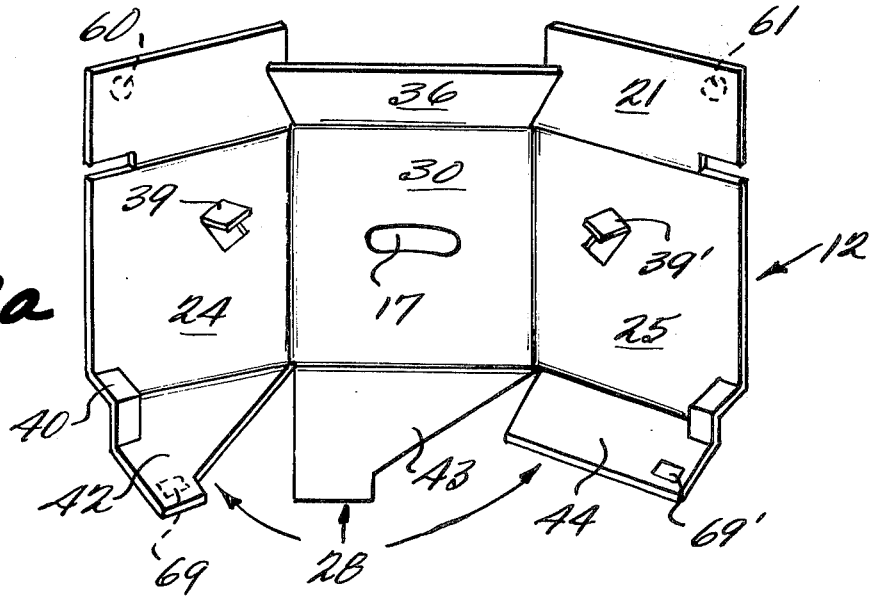
FIGS. 2*a*–2*d* are perspective views of a top cutout, bottom cutout, divider cutout, and support member cutout, respectively, that are assembleable to form the target of FIG. 1.

The target 10 of FIG. 1 preferably may be readily assemblable from cardboard (or like stiff sheet material) cutouts that are prescored so that they may be folded at various parts thereof. The top part 12 of the target 10 comprises a cutout (see FIG 2*a*) comprising a top wall 30, a pair of side wall portions 24 and 25 forming the side walls of the upper chamber 18, a pair of side flaps 20, 21, and three interengaging back-wall portion forming flaps 42, 43, 44, which interlock together to form the back wall 28 of the upper chamber 18 of target 10. A flap 36 is also provided associated with cutout 12, which flap bends back toward the interior of the target (generally deflecting balls striking it generally toward the interior of the target 10), and is held in such a position by tabs 39, 39′ formed from the side wall portions 24, 25, respectively.

Figure 2B:
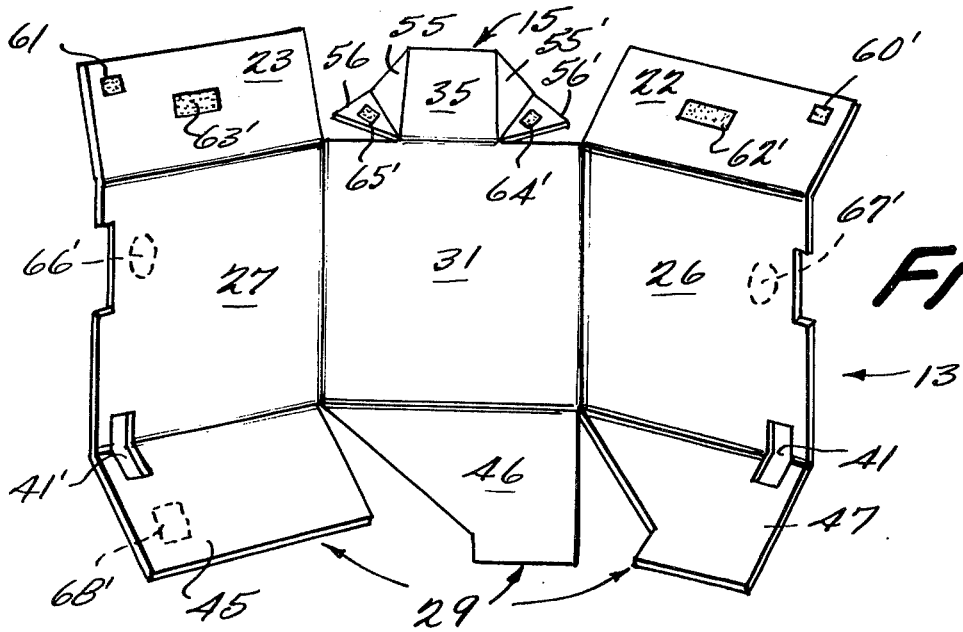

The bottom part 13 of the target 10 comprises a cutout (see FIG. 2*b*) comprising a bottom wall 31, a pair of side wall portions 26, 27 forming the side walls of the lower chamber 19, a pair of side flaps 22, 23, and three interengaging back-wall portion forming flaps 45, 46, 47, which interlock together to form the back wall 29 of the lower chamber 19 of target 10. A tab member 35 is also provided associated with cutout 13, which member 35 has appended portions 55, 55′, 56 and 56′ thereof, which portions are foldable with respect to member 35 and support 11 to form pocket 15 attached to the front of support 11.

Figure 2C:
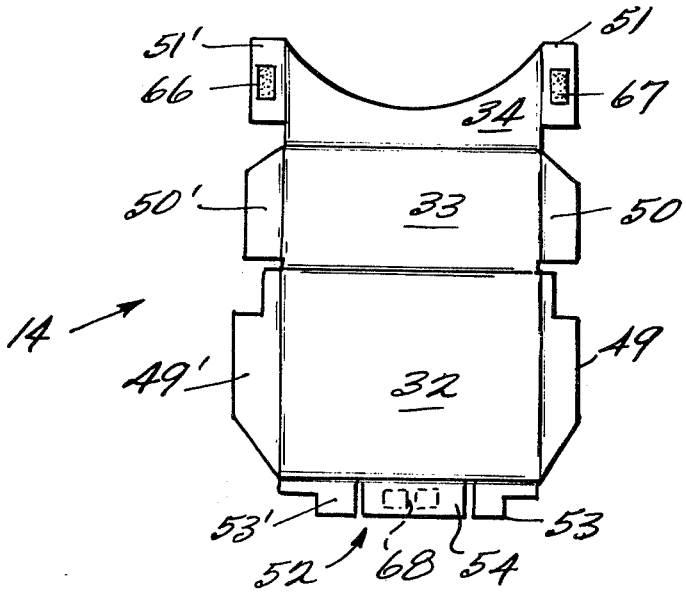
Figure 2D:
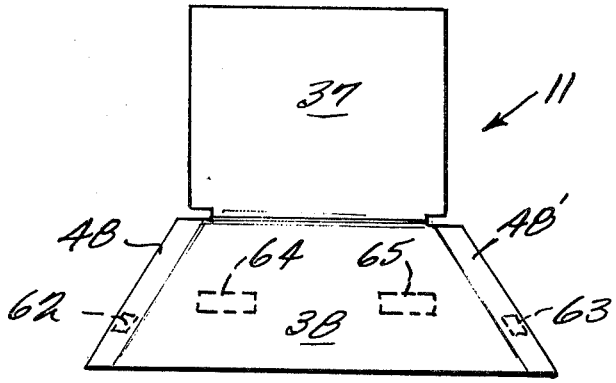

The divider 14 of the target 10 comprises a cutout (see FIG. 2*c*) comprising a top portion 34, a front portion 33, and a bottom portion 32. As can be seen in FIG. 1, when the divider 14 is folded properly, the member 14 divides the upper and lower chambers 18, 19, and allows a ball that enters upper chamber 18 to be retained therein, the ball eventually coming to rest in the depression formed by portions 32, 33 of divider 14. The support 11 of the target 10 comprises a cutout (see FIG. 2*d*) which comprises a front portion 38, having flaps 48, 48′ thereof adapted to be attached to the side flaps 16 of the target 10, and a portion 37 thereof which is adapted to be disposed over the bottom face 31 of bottom cutout 13.

All of the cutouts interengage to form the assembled structure 10, various means being employed for effecting secure interengagement including cutout and projecting portions, and Velcro strips or the like. The flaps 42, 43, 44 and 45, 46, 47 are joined together merely by folding them into friction engagement with each other. Additionally, Velcro strips 69, 69′ may be fastened together to hold the flaps 42, 43, 44 in their desired position (in the following description, a Velcro strip of a given reference numeral interfits with another Velcro strip of the corresponding prime reference numeral). The top and bottom chambers 18, 19 are formed by folding the respective sets of flaps 42, 43, 44 and 45, 46, 47 into interfitting engagement with each other, and the top and bottom chambers are then assembled together by attaching strips 60, 60′ and 61, 61′ of the side flap members 20, 22 and 21, 23, respectively. Also, flexible joint members 40, 40′ are folded into slots 41, 41′, respectively, to provide an interfitting engagement. The divider 14 is held in proper position within the target 10 by strips 66, 67 of tabs 51, 51′ of divider top portion 34 cooperating with corresponding strips 66′, 67′ formed on side wall portions 26, 27 of cutout 13 (with tabs 50, 50′ and 49, 49′ abutting corresponding interior portions of the target 10), and by the exterior tab assembly 52 which includes tabs 53, 53′ which are adapted to be placed inside of chamber 19 in engagement with the inside of the back 29 of the chamber 19, and tab 54 which is adapted to be placed outside of chamber 19 in engagement with the outside of the back 29 of the chamber 19, strip 68 on tab 54 mating with strip 68′ formed on the outside of flap 45. The support 11 is connected to the rest of the target 10 by mating strips 62, 63 on flaps 48, 48′ of front portion 38 with strips 62′, 63′ formed on side flap members 22, 23, respectively, by disposing bottom portion 37 in abutting engagement with bottom 31, and by mating strips 64, 65 with strips 64′, 65′ formed on tabs 56′, 56, respectively, of pocket 15 forming tab 35. The target 10 as assembled may be lifted up, as by hand-cutout 17, and carried from place to place, and of course may be readily disassembled and folded up and stored in a convenient manner, as in box B of FIG. 4. While the target 10 when assembled as shown in FIG. 1 is of course three-dimensional, when folded up after disassembly, it consists essentially of flat sheets (and/or doubled over sheets), which do not have a large thickness and therefore, the assembly may essentially be considered to be two-dimensional rather than three-dimensional.

Another target 110 according to the present invention is shown in FIG. 3 in its assembled condition. The target 110 comprises a top frame member 80, which is formed of four pieces of wire or the like defining the sides thereof, and a bottom frame member 81 of the same construction as member 80, and interconnected by a telescoping rod 84 or the like. Cross-members 85, 86 may be provided for members 80, 81 if desired for releasable or permanent connection to rod 84. Also, a divider frame 82 may be provided for dividing the target 110 into upper and lower chambers. The frames 80, 81 (and 82) may all be covered with fabric or the like, providing closed top, back, bottom, and side walls for the target 110, and leaving an open front, and when the rod 84 is telescoped inwardly (or disconnected from frames 80, 81), the whole target 110 is foldable into a compact, essentially two-dimensional package. Of course, instead of a wire frame 82 being provided, a divider made of fabric may be sewed to the middle portions of fabric sections forming the back and side walls of the target 110, as long as a depressed area 83 or the like is provided for retaining a ball within the upper chamber of the target 110.

Also associated with the target 110 are side flaps 116 which are comprised of fabric sheets or the like supported by wires 88. The wires 88 are connected at joints 90, 91 to the upper and lower wire frames 80, 81, and preferably the connections are pivot joints so that the flaps 116 are pivotal with respect to the main body of the target 110. Support 111 has wire supports 93 thereof also connected at joints 91, and preferably wires 93 are universally pivotal with respect to bottom support 81. Pocket 115 is mounted on the fabric front of support 111, wires 95 defining the open part of the pocket 115, which wires 95 are connected at pivots 96 to the bottom frame 81. While a telescoping rod 84 is shown, other suitable means for allowing movement of the top frame 80 with respect to the bottom frame 81 for folding up of the target 110 could also be provided — such as a plurality of arms pivoted to one another and lockable at the joints thereof in a straight position with respect to each other.

It will thus be seen that according to the present invention, a target game has been provided that allows one to play a plurality of different games therewith, and which provides a target that is readily assembleable to form a three-dimensional structure from an essentially two-dimensional structure, and disassembleable to form an easily stored two-dimensional structure. While the invention has been herein shown and described in what are presently conceived to be the most practical and preferred embodiments, it will be apparent to one of ordinary skill in the art that many modifications may be made thereof within the scope of the invention, which scope is to be accorded the broadest interpretation of the appended claims so as to encompass all equivalent structures and devices.

What is claimed is:

1. A game comprising a ball, a target comprising closed side, back, top and bottom walls and a generally open front, a divider in said target dividing said target into bottom and top chambers, said divider having means associated therewith for retaining a ball in said top chamber which enters said target above said bottom chamber through said generally open front, side flap members vertically extending along either side of said generally open front of said target, the plane of each flap member making an angle of greater than 90° with respect to the plane of the generally open front of said target, and means for retaining a ball in said bottom chamber that enters said bottom chamber of said target below said top chamber through said generally open front.

2. A game as recited in claim 1 further comprising a flap portion formed on the top of said target, and extending from the top of said target at the generally open front thereof into the interior of said target, said flap portion making an angle of less than 90° with respect to said top of said target and for guiding a ball into the top chamber of said target.

3. A game as recited in claim 1 wherein said means retaining a ball in said bottom chamber comprises a support member extending across the open front of said target at the bottom thereof, said support member having a height less than the height of said target bottom chamber, and said support member supporting a pocket on the front thereof, said pocket being large enough to receive said ball therein, whereby a target is provided having upper and lower chambers for receipt of balls therein, and a pocket for receipt of a ball therein.

4. A game as recited in claim 3 wherein said support member is operatively connected to each of said flap members and to the bottom of said target.

5. A game as recited in claim 1 wherein a telescoping pole is operatively connected to said top and bottom walls of said target, said pole being extendable to provide said open top and bottom chambers of said target.

6. A game as recited in claim 1 wherein said target is readily assembleable and disassembleable to allow storage in a compact, substantially two-dimensional arrangement.

7. A game as recited in claim 6 wherein said target is constructed from a top cutout, a bottom cutout and a divider cutout, each formed of foldable sheet material, said top cutout comprising said top wall, the top chamber portions of said side walls, the top chamber portions of said side flap members, and three interengaging back wall-forming flaps interlockable together to form the top chamber portion of said target back wall, said bottom cutout comprising said bottom wall, the bottom chamber portions of said side walls, the bottom chamber portions of said side flap members, and three interengaging back wall-forming flaps interlockable together to form the bottom chamber portion of said target back wall, said divider cutout comprising a top portion, a front portion, and a bottom portion, means associated with said divider cutout for attaching said divider cutout to the back wall and side walls of said target, and means associated with said top and bottom cutouts for attaching said cutouts together, with said divider cutouts disposed therebetween, for forming said target.

8. A game as recited in claim 7 further comprising a flap portion formed on the top of said target and extending from the top of said target, when assembled, at the generally open front thereof into the interior of said target, said flap portion making an angle of less than 90° with respect to said top of said target, said flap portion comprising part of said top cutout, and retaining members being formed in said side wall portions of said top cutout for retaining said flap portion in desired assembled position after assembly of said target.

9. A game as recited in claim 7 further comprising a support member extending across the open front of said target at the bottom thereof, said support member having a height less than the height of said target bottom chamber, and said support member for supporting a pocket large enough to receive a ball therein on the front thereof, said support member comprising a support member cutout formed from a sheet of foldable material and having a front portion thereof with flaps attached thereto, said flaps being operatively connectable to said flap members of said bottom chamber portion of said target, and wherein said pocket comprises a tab attached to said bottom cutout and foldable in front of said support, and further comprising and means for attaching said support member to said side flap members of the bottom chamber portion of said target, and means for attaching said pocket to said support member.

10. A game as recited in claim 7 wherein said means for attaching said top and bottom cutouts together comprising cooperating Velcro strip portions formed on said flap members and cooperating tab and opening portions formed with said top and bottom cutouts.

* * * * *